United States Patent [19]

Mizutani et al.

[11] 3,953,352

[45] Apr. 27, 1976

[54] ACIDIC CLEANING COMPOSITION

[75] Inventors: Hiroshi Mizutani, Yachiyo; Miwako Abe, Ichikawa; Yumio Nakasone, Funabashi, all of Japan

[73] Assignee: Kao Soap Co., Ltd., Tokyo, Japan

[22] Filed: May 31, 1974

[21] Appl. No.: 475,636

[30] Foreign Application Priority Data

June 4, 1973 Japan ..... 48-62821

[52] U.S. Cl. ..... 252/142; 252/542; 252/DIG. 14

[51] Int. Cl.[2] ..... C11D 3/28; C23G 1/02

[58] Field of Search ..... 252/142, 143, 542, 148, 252/171, 136, 524, DIG. 14, DIG. 11; 134/3, 41; 260/326.45, 527 N, 529

[56] References Cited

UNITED STATES PATENTS

| | | | |
|---|---|---|---|
| 2,757,125 | 7/1956 | Mudrak | 260/326.45 |
| 3,322,675 | 5/1967 | Diehl | 252/524 |
| 3,692,684 | 9/1972 | Hentschel et al. | 252/89 |
| 3,791,986 | 2/1974 | Mallico | 252/542 |

*Primary Examiner*—Mayer Weinblatt
*Assistant Examiner*—R. Eugene Varndell, Jr.
*Attorney, Agent, or Firm*—Woodhams, Blanchard and Flynn

[57] ABSTRACT

An acidic cleaning composition comprising at least 0.1 weight percent of pyrrolidone-carboxylic acid or derivatives thereof having the following formula

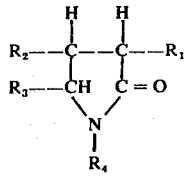

wherein $R_1$, $R_2$ and $R_3$ are hydrogen, —COOH, $—CH_3$, $—C_2H_5$ or —OH with the proviso that at least one of $R_1$, $R_2$ and $R_3$ is —COOH, and $R_4$ is hydrogen, $—CH_3$ or $—C_2H_5$.

6 Claims, No Drawings

ACIDIC CLEANING COMPOSITION

BACKGROUND OF THE INVENTION

1. Field of the Invention

This invention relates to an acidic cleaning composition having an excellent cleaning effect and which is low in toxicity and skin irritating effect.

2. Description of the Prior Art

Dirt, soils and stains on various surfaces in dwellings, clothes, tableware, human bodies and the like are ordinarily removed by neutral or alkaline cleaners or detergents. For some types of soils, ammonia, caustic alkali, and organic solvents such as petroleum solvents, chlorinated hydrocarbons, grime solvents, alcohols, ethers and ketones are also often employed.

However, there are special soils or stains that are difficult or impossible to remove by the foregoing cleaners, detergents or chemicals. As examples of such special soils and stains, there can be mentioned stains on toilet bowls, urinals, bath tubs and the like, stains of juices or tannins and the like from plants or vegetables, stains of alcoholic drinks, rusts of metals such as iron, spots of chemicals such as mercurochrome and tincture of iodine, ink spots, soils on bathtubs or washing pails, and the like. Acidic substances or cleaners containing acidic substances are sometimes effective for removing these special soils and stains. As acid substances heretofore commonly used for this purpose, there can be mentioned inorganic acidic substances such as hydrochloric acid, sulfuric acid, phosphoric acid, nitric acid, sodium bisulfate and potassium bisulfate, and organic acids such as sulfamic acid, oxalic acid and acetic acid. These acidic substances have an excellent soil-removing ability, but each of them is irritating to the skin and has significant toxicity and/or smell. Therefore, they cannot always be used with safety. Especially, oxalic acid, which is effective as a spot remover or rust remover and which exhibits an excellent effect as a toilet bowl cleaner when used in combination with hydrochloric acid, has a very high toxicity and a high skin-penetrating property, and therefore, handling or use of compositions containing oxalic acid requires considerable care.

It is therefore a primary object of this invention to provide an acidic cleaning composition in which the disadvantages of conventional acidic cleaners are greatly reduced, and which can be used with increased safety because of its reduced toxicity and skin-irritating property and which exhibits an excellent cleaning ability.

SUMMARY OF THE INVENTION

According to this invention, there is provided a liquid, powder or solid cleanng composition comprising at least 0.1 weight percent of one or more pyrrolidone-carboxylic acid compounds having the following formula

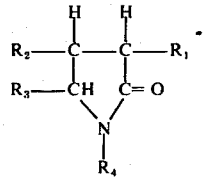

wherein $R_1$, $R_2$ and $R_3$, which can be the same or different, are hydrogen, —COOH, $—CH_3$, $—C_2H_5$ or —OH with the proviso that at least one of $R_1$, $R_2$ and $R_3$ is —COOH, and $R_4$ is hydrogen, $—CH_3$ or $—C_2H_5$. Specific preferred compounds of the above formula include 2-pyrrolidone-5-carboxylic acid, 2-pyrrolidone-3,5-dicarboxylic acid and N-methyl-2-pyrrolidone-5-carboxylic acid.

In this invention, if the amount of the pyrrolidone-carboxylic acid compound in the composition is lower than 0.1 weight percent, the cleaning ability is insufficient and the object of this invention cannot be attained. The upper limit of the amount of the pyrrolidone-carboxylic said compound in the composition is not critical in this invention. In the case of a liquid cleaning composition, however, the upper limit of the pyrrolidone-carboxylic acid compound is determined by the solubility of said compound in the solvent. For example, when the pyrrolidone-carboxylic acid compound is dissolved in water, the upper limit thereof is about 5 weight percent. However, if a surface active agent is also used in such liquid composition, the upper limit of the amount of the pyrrolidone-carboxylic acid compound can be increased to about 20 weight percent.

The cleaning and soil-removing ability of the acidic cleaning composition according to this invention can be further increased by incorporating in the composition one or more of the following ingredients. For instance, anionic, nonionic, cationic and ampholytic surfactants can be used for promoting the penetration of the cleaning liquor into the soil for dispersing and emulsifying dislodged soil, for preventing redeposition of soil on the cleaned surface and for increasing the solubility of the pyrrolidone-carboxylic acid component in water. Further, solvents such as Cellosolves or Carbitols can be used for swelling soil and enhancing the cleaning ability of the acid component. It is also possible to use the acidic cleaning composition according to this invention in combination with other acidic substances. When a thick layer of soil on a toilet bowl or the like is to be removed, it is preferred to employ hydrochloric acid in combination with the pyrrolidone-carboxylic acid compound in a liquid cleaning composition and to use a bisulfate in combination with the pyrrolidone-carboxylic acid compound in a powdery detergent composition.

As auxiliary components, there can be used lower alcohols such as ethanol and propanol, polyhydric alcohols such as propyleneglycol, lower alkyl (C 1 to C 3 ) benzenesulfonates, urea and the like, added as hydrotropic materials in the case of a liquid cleaning composition. Sodium sulfate and sodium chloride can be used as builders in the case of a powder or solid cleaning composition. Since the cleaning composition of this invention is acidic and there is a risk that it may promote corrosion of some metals, it is preferred to incorporate a metal corrosion-inhibitor in the composition. Moreover, perfumes, pigments, dyes and other additives can be incorporated appropriately, in accordance with conventional practice.

Thus, in accordance with this invention, there is provided a liquid acidic cleaning composition containing at least 0.1 weight percent of at least one pyrrolidone-carboxylic acid compound of the above formula. The maximum amount of said compound contained in the liquid cleaning composition is the maximum that can be dissolved in the solvent system. Hydrotropic agents can be used to increase the solubility of the compound in an aqueous solvent solution. It is preferred to employ a liquid composition consisting essentially of:

| | | |
|---|---|---|
| 1. | pyrrolidone-carboxylic acid compound of the above formula | 0.1 to 20 weight percent, especially 1 to 6 weight percent |
| 2. | hydrotropic agent selected from ethanol, propanol, ethylene glycol, propylene glycol, alkyl (C 1 to C 3 ) benzenesulfonates, urea and mixtures thereof | up to 10 weight percent, as needed to dissolve pyrrolidone-carboxylic acid compound |
| 3. | water | balance |

Another preferred liquid composition according to this invention consists essentially of:

| | | |
|---|---|---|
| 1. | hydrochloric acid | 5 to 15 weight percent, especially 8.5 to 10.5 weight percent |
| 2. | pyrrolidone-carboxylic acid compound of the above formula | 0.1 to 20 weight percent, especially 1 to 5 weight percent |
| 3. | hydrotropic agent selected from ethanol, propanol, ethylene glycol, propylene glycol, alkyl (C 1 to C 3 ) benzene sulfonates, urea and mixtures thereof | up to 10 weight percent, as needed to dissolve pyrrolidone-carboxylic acid compound |
| 4. | water | balance |

Both of the above liquid compositions can include one or more optional additive materials. For example, there can be used up to 10 weight percent, especially 3–10 weight percent, of anionic, cationic, nonionic or ampholytic surfactants. As the surfactant it is preferred to use water-soluble anionic and nonionic surfactants including soaps such as sodium or potassium salts of fatty acids or rosin acids or tall oil; alkylbenzene sulfonates in which the alkyl group is from 8 to 18 carbon atoms; alkyl sulfates including those with both branched-chain and straight-chain hydrophobes and primary and secondary sulfate groups in which the alkyl group is from 8 to 18 carbon atoms; ethoxylated alkylphenols in which the alkyl group is from 8 to 18 carbon atoms and the moles of ethylene oxide per mol of alkyl hydrophobe is from 1.5 to 30; ethoxylated aliphatic alcohols in which the aliphatic group is from 8 to 18 carbon atoms and the mols of ethylene oxide per mol of aliphatic hydrophobe is from 5 to 30; ethoxylated alkylphenol sulfates in which the alkyl group is from 8 to 18 carbon atoms and the moles of ethylene oxide per mol of alkyl hydrophobe is from 1 to 30; ethoxylated aliphatic alcohol sulfates in which the aliphatic group is from 8 to 18 carbon atoms and the moles of ethylene oxide per mol of aliphatic hydrophobe is from 5 to 30; glycerol esters of fatty acids of from 8 to 18 carbon atoms; sugar esters of fatty acid of from 8 to 18 carbon atoms; polyoxyethylene esters of fatty acids of from 8 to 18 carbon atoms and of from 180 to 1500 total molecular weight; esters of sorbitan with aliphatic acids of from 8 to 18 carbon atoms; polyoxypropylene-polyoxyethylene block copolymers of molecular weight of at least 900 up to 3250; $\alpha$-olefin sulfonates having 13 to 20 carbon atoms and alkane sulfonates in which the alkane is from 10 to 20 carbon atoms. There can be used minor amounts of less than one weight percent of perfumes, dyes and disinfectants in accordance with conventional practice. There can also be used up to 10 weight percent, especially 3-10 weight percent, of mono- or di-ethylene glycol monoalkyl (C1 to C4) ethers, such as ethylene glycol mono methyl ether (methyl cellosolve), di-ethylene glycol mono methyl ether (methyl carbitol), ethylene glycol mono ethyl ether (cellosolve), di-ethylene glycol mono ethyl ether (carbitol), ethylene glycol mono butyl ether (butyl cellosolve), and ethylene glycol mono butyl ether (butyl carbitol).

Also, in accordance with this invention, there is provided a solid acidic cleaning composition containing at least 0.1 we weight percent of at least one pyrrolidone-carboxylic acid compound of the above formula. The maximum amount of said compound is not critical, but it is preferred to use in the composition a maximum of about 50 weight percent, preferably 20 weight percent, of said compound. The balance of the composition is comprised of acidic or neutral, inorganic compounds, especially water-soluble inorganic salts such as sodium sulfate, sodium chloride, sodium bisulfate, potassium bisulfate and mixtures thereof. There can also be included solid abrasives such as silica. The amounts of these additional inorganic compounds can be selected in accordance with conventional practice in view of the intended use of the particular composition.

The pyrrolidone-carboxylic acid compounds used in this invention have low toxicity and skin-irritating properties. Therefore, the cleaning compositions according to this invention can be handled or used without special precautions. In this point, the composition of this invention is much superior to conventional acidic cleaners. Further, owing to the characteristic activity of pyrrolidone-carboxylic acid compounds, the cleaning composition of this invention has high cleaning and soil removing functions with regard to the above-mentioned special soils and stains.

More specifically, the pyrrolidone-carboxylic acid compounds make soils and stains adhering on toilet bowls and the like readily dispersible or soluble in water because they decompose calcium phosphate which is the main component of such soils, with the result that these soils can be removed effectively. Further, the pyrrolidone-carboxylic acid compounds make soils of tannin, juices or the like of plants readily dispersible or soluble in water by decomposing the organic metal salts contained in these soils, with the result that these soils can be removed effectively.

The effects of this invention will be further described in the following illustrative examples.

EXAMPLE 1

Toilet Bowl Cleaner

The same amounts of the cleaning compositions described below were sprinkled onto soil adhered on non-flush type urinals and to yellow stains adhering on flush type toilet bowls. After about 3 minutes, the urinals and toilet bowls were rubbed with a swab and then rinsed with water. The degree of removal of the soils and stains was visually judged. The results shown in Table 1 were obtained.

In this test, the cleaning compositions used had the following formulation. Only the organic acid ingredients were different in the respective compositions.

| | |
|---|---|
| hydrochloric acid | 9.5 wt.% |
| organic acid (as listed in Table 2) | 2.0 wt.% |
| polyoxyethylene ($\bar{p}$=12)alkyl(C12-C14) ether | 0.5 w.% |
| alkyl(C14–C18)dimethyl benzyl ammonium chloride | 1.0 wt.% |

-continued

| | |
|---|---|
| pigment | 0.003 wt.% |
| perfume | 0.1 wt.% |
| water | balance |

Table 1

| Sample No. | organic acid | Dirt Removal Effect soil on urinals | yellow soil on flush toilets |
|---|---|---|---|
| 1 | PCA* | good removal | good removal |
| 2 | oxalic acid | good removal | good removal |
| 3 | citric acid | good removal | removal being slightly difficult |
| 4 | tartaric acid | good removal | removal being slightly difficult |
| 5 | not added | good removal | removal being slightly difficult |

Notes
*PCA indicates 2-pyrrolidone-5-carboxylic acid

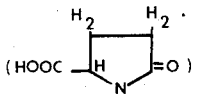

The cleaning composition according to this invention containing PCA exhibited a good cleaning effect comparable to that of the most effective conventional cleaning composition containing oxalic acid. When compositions containng the other organic acids were used, the cleaning effect was reduced. The handling of oxalic acid is very dangerous because of its high toxicity and skin irritating property. But PCA used in this invention does not have such a high toxicity and it can be handled with ease and safety.

EXAMPLE 2

Bathroom Cleaner

Using the cleaning compositions described below, cleaning tests were carried out on soils adhered on a bathtub and yellow soil formed by iron oxide or the like contained in water. Soils adhered on bathtubs and plastic pails are composed mainly of calcium and magnesium salts of fatty acids produced by using soap with hard water. In this case, plastic pails having an adherent soil layer of a thickness of about 0.5 mm, were employed. Yellow soils formed by iron oxide or the like are soils of a yellowish brown color which are observed on the portion of bathtubs that contact the surface of the water therein and around the drain passage in a bathtub, pottery washbowls and flush toilet bowls. In this case, a flush toilet bowl having an adherent soil layer thereon was employed. The cleaning was conducted by sprinkling the same amounts of the test liquids on the surface and rubbing the dirty surface under a constant pressure with a piece of sponge. The time required for complete removal of the soils was measured. The results are shown in Table 2.

In this test, the cleaning compositions employed had the following formulation. Only the cleaning ingredients were different in the respective compositions.

| Cleaning ingredients (as listed in Table 2) | |
|---|---|
| Urea | 5 wt.% |
| pigment | 0.005 wt.% |
| perfume | 0.1 wt.% |
| water | balance |

Table 2

| Sample No. | Cleaning Ingredients PCA | LAS-Na | BC | Removal Effect Soil stuck on bathtub | Yellowish Soil |
|---|---|---|---|---|---|
| 6 | 0 | 5 wt.% | 5 wt.% | more than 5 minutes | removal was impossible |
| 7 | 5 wt.% | 5 wt.% | 5 wt.% | 23 seconds | 60 seconds |
| 8 | a commercially available household cleaner | | | 65 seconds | removal was impossible |

Notes:
PCA: 2-pyrrolidone-5-carboxylic acid
LAS-Na: sodium salt of straight chain alkylbenzenesulfonic acid
BC: butyl cellosolve
Sample 8: a commercially available household detergent composed mainly of anionic and nonionic surfactants From these results, it will readily be understood that the cleaning composition according to this invention containing PCA (sample 7) had an unexpectedly improved cleaning power with respect to soil adhered on bathtub in comparison with the other cleaning compositions tested, and that the cleaning composition according to this invention had a high cleaning power to yellow soil formed by iron oxide or the like contained in water, which yellow soil could scarcely be removed by the other cleaning compositions tested.

EXAMPLE 3

Stain Remover

Stain removal was conducted on a test cloth using an aqueous solution containing 5 weight percent of ethanol and 3 weight percent of 2-pyrrolidone-5-carboxylic acid. The soiled test cloth was a cotton cloth which was spotted with ink, tea tannin and vegetable juice. This cloth was dipped in the above stain-remover solution and then was rubbed with fingers. The stains were removed easily.

Thus, it will readily be understood that the cleaning composition of this invention is effective also as a stain remover.

EXAMPLE 4

Bathroom Cleaner

Soiled portions of a plastic pail were cut into test pieces of a size of about 10 cm square and the cleaning power test was conducted on these test pieces using a washerbility tester applicable to the hard surface washing test (as described in JIS K-5663).

The test was conducted by fixing the edges of a pair of test pieces on which soil was adhered to the same extent, to a prescribed position of the washerbility tester using an adhesive tape, pouring onto separate portions of the test piece 3 g of a liquid composition according to this invention and one of cleaners A, B and C (commercially available household cleaners) indicated below, moving a rubbing member provided with a sponge reciprocatively (the load imposed on the test piece being 295 g) and measuring the number of times of reciprocative movement necesary for complete removal of soils from the test pieces. The results are shown in Table 3.

Since it was difficult to obtain test pieces with the same degree of soiling, the test pieces were collected from the same plastic pails and the cleaning tests were always conducted by employing a comparison cleaner A, B or C to determine the cleaning ability in a relative manner.

| Composition of Bathroom Cleaner Liquid according to this invention | |
|---|---|
| 2-pyrrolidone-3,5-dicarboxylic acid | 5 % by weight |
| polyoxyethylene($\bar{p}$=12) alkyl(C12-C14) ether | 3 % by weight |
| butyl carbitol | 3 % by weight |
| water | 89 % by weight |

Table 3

Results of Measurement of Number of Times of Reciprocative Movement of Washerbility Tester Required for Removal of Soil

| Run No. | Testing Liquid of This Invention | Commercially Available Household Cleaners A (pH=10.3) | B (pH=12.0) | C (pH=8.0) |
|---|---|---|---|---|
| 1 | 5 | 13 | — | — |
| 2 | 4 | — | 9 | — |
| 3 | 7 | — | — | 31 |

It will be readily understood that the cleaner of this invention is also effective in removing soil in bathrooms.

The embodiments of this invention in which exclusive property or privilege is claimed are defined as follows:

1. A liquid acidic cleaning composition for removing adherent soils and stains from hard surfaces and fabrics consisting essentially of (*a*) from 0.1 to 20 weight percent of at least one pyrrolidone-carboxylic acid compound having the formula:

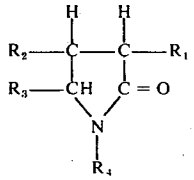

wherein $R_1$, $R_2$ and $R_3$, which can be the same or different, are hydrogen, —COOH, $—CH_3$, $—C_2H_5$ or —OH with the proviso that at least one of $R_1$, $R_2$ and $R_3$ is —COOH, and $R_4$ is hydrogen, $—CH_3$, or $—C_2H_5$, (*b*) up to 10 weight percent of anionic, cationic, nonionic, or ampholytic water-soluble surfactants effective to promote penetration of the cleaning composition for dispersing and emulsifying disloged soil, (*c*) up to 10 weight percent of mono-or di-ethylene glycol mono alkyl ($C_1$ to $C_4$) ethers, (*d*) up to 10 weight percent of hydrotropic agent selected from the group consisting of ethanol, propanol, ethylene glycol, propylene glycol, alkyl ($C_1$ to $C_3$) benzene sulfonates, urea and mixtures thereof, sufficient to dissolve (*a*), and (*e*) the balance is water.

2. An acidic cleaning composition according to claim 1, wherein said pyrrolidone carboxylic acid compound is selected from the group consisting of 2-pyrrolidone-5-carboxylic acid, 2-pyrrolidone-3,5-dicarboxylic acid and N-methyl-2-pyrrolidone-5-carboxylic acid.

3. A liquid acidic cleaning composition according to claim 1, consisting essentially of a. from 0.1 to 20 weight percent of said pyrrolidone carboxylic acid compound, b. up to 10 weight percent of hydrotropic agent selected from the group consisting of ethanol, propanol, ethylene glycol, propylene glycol, alkyl ($C_1$ to $C_3$) benzene sulfonates, urea and mixtures thereof, sufficient to dissolve (a), and c. the balance is water.

4. A liquid acidic cleaning composition according to claim 1, consisting essentially of a. from 0.1 to 5 weight percent of said pyrrolidone carboxylic acid compound, and b. the balance is water.

5. A liquid cleaning composition for removing adherent soil and stains from hard surfaces and fabrics, consisting essentially of a. from 5 to 15 weight percent of hydrochloric acid, b. from 0.1 to 20 weight percent of at least one pyrrolidone carboxylic acid compound having the formula:

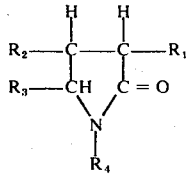

wherein $R_1$, $R_2$, and $R_3$, which can be the same or different, are hydrogen, —COOH, $—CH_3$, $—C_2H_5$ or —OH with the proviso that at least one of $R_1$, $R_2$ and $R_3$ is —COOH, and $R_4$ is hydrogen, $—CH_3$, or $C_2H_5$, c. up to 10 weight percent of hydrotropic agent selected from the group consisting of ethanol, propanol, ethylene glycol, propylene glycol, alkyl ($C_1$ to $C_3$) benzene sulfonates, urea and mixtures thereof, sufficient to dissolve (b), and d. the balance is water.

6. A solid acid cleaning composition for removing adherent soils and stains from hard surfaces and fabrics, consisting essentially of a. from 0.1 to 50 weight percent of at least one carboxylic acid compound having the formula:

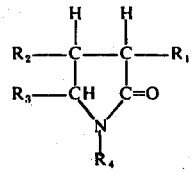

wherein $R_1$, $R_2$ and $R_3$, which can be the same or different are hydrogen, —COOH, $—CH_3$, $—C_2H_5$ or —OH with the proviso that least one of $R_1$, $R_2$ and $R_3$ is —COOH, and $R_4$ is hydrogen, $—CH_3$ or $C_2H_5$, and b. the balance is at least one substance selected from the group consisting of sodium chloride, sodium sulfate, sodium bisulfate and potassium bisulfate.

* * * * *